United States Patent [19]

Gavin et al.

[11] Patent Number: 4,843,788

[45] Date of Patent: Jul. 4, 1989

[54] MODULAR SECLUSION ROOM

[75] Inventors: F. Paul Gavin, Mason, N.H.; Debra J. Peloquin, Holden, Mass.

[73] Assignee: Moduform, Inc., Fitchburg, Mass.

[21] Appl. No.: 142,795

[22] Filed: Jan. 11, 1988

[51] Int. Cl.[4] ..... E04H 3/08

[52] U.S. Cl. ..... 52/205; 52/79.1; 52/106; 52/238.1; 52/285; 52/750; 5/93 R; 128/846

[58] Field of Search ..... 52/79.1, 79.5, 79.12, 52/264, 274, 285, 288, 289, 309.8, 403, 239, 205, 106; 5/93 R, 99 C, 99 B, 1, 10 R, 100, 238.1

[56] References Cited

U.S. PATENT DOCUMENTS

| | | | |
|---|---|---|---|
| 564,299 | 7/1896 | Bailey | 52/285 X |
| 2,927,665 | 3/1960 | Hauf | 52/403 X |
| 2,953,873 | 9/1960 | Tatro | 52/289 X |
| 3,363,378 | 1/1968 | Palfey | 52/285 X |
| 3,503,167 | 3/1970 | Mackie . | |
| 3,923,134 | 12/1975 | Rezazadeh | 52/79.1 X |
| 3,994,105 | 11/1976 | Jamison | 52/285 X |
| 4,366,882 | 1/1983 | Parker | 181/198 |
| 4,463,049 | 6/1984 | Kracke | 428/281 |
| 4,571,904 | 2/1986 | Kessler et al. | 52/205 |
| 4,715,154 | 12/1987 | Baloga | 52/239 |

FOREIGN PATENT DOCUMENTS

| | | | |
|---|---|---|---|
| 741049 | 8/1966 | Canada | 52/79.1 |
| 806379 | 12/1936 | France | 52/264 |
| 906493 | 9/1962 | United Kingdom | 52/309.8 |

*Primary Examiner*—David A. Scherbel
*Assistant Examiner*—Richard E. Chilcot, Jr.
*Attorney, Agent, or Firm*—Hamilton, Brook, Smith & Reynolds

[57] ABSTRACT

A modular seclusion room for confining violent patients wherein the four walls and floor are lined with a padded lining that is abrasion resistant, fire retardant, and shock absorbent. Ventilation and lighting are provided through the ceiling of the room and with access provided by an externally controlled closeable door through one wall. The seclusion room is portable and modular so that it may be quickly assembled within an existing structure in a number of possible sizes and configurations.

16 Claims, 3 Drawing Sheets

MODULAR SECLUSION ROOM

BACKGROUND

The present invention relates to facilities used for housing patients who are violent to others or to themselves, and more particularly to a modular seclusion room for confining such patients.

The treatment of violent or self-abusive individuals has generally taken the form of one or a combination of three different modalities. First, drugs have been used to calm individuals in a violent state. However, this form of treatment often has a number of deleterious side effects, including addiction. The second principal form of dealing with the violent patient is through physical restraint. This type of treatment is often used with drug therapy and can often inhibit the recovery process, where some freedom of movement is desirable.

The third method is by placing the individual in an enclosed space or room that has been padded in some way to prevent self-inflicted injuries. This form of confinement isolates the individual thereby preventing injuries to health-care personnel or other patients.

Confinement has often taken the form of simply placing padded mattresses on the walls and floor of an existing room, or using an enclosure designed for non-violent patients. These methods typically do not have the durability or the safety features necessary.

For example, U.S. Pat. No. 4,571,904 discloses a patient enclosure used in the treatment of severely brain damaged patients. The enclosure is padded and placed within an existing room. Both inner and outer rooms are environmentally pleasant to enhance the recovery of the brain damaged patient. The inner enclosure is at the shoulder height of the patient so that he or she easily perceives the surrounding environment. This type of structure is not suitable for the violent patient where the principal concerns are safe confinement and isolation.

SUMMARY OF THE INVENTION

A seclusion room of the present invention used for confining a violent patient which has four walls and a floor whose interior surfaces are padded and covered with a lining such that the surface is abrasion resistant, fire retardant, and shock absorbent. Both interior and exterior surfaces are tamper resistant to prevent easy dismantling or destruction of the unit. A metal frame is used to support the structure consisting of an outer laminated surface, a panel that is fire retardant, a foam padding and a seamless fabric coating. The padding is fire retardant and has substantial shock absorbing characteristics. The fabric coating or lining on the interior surfaces of the room is non-abrasive and free of materials used to secure the lining to the wall. The lining on each surface of the panelling is secured at seams around the edges of each panel to the backing.

A door is provided in one wall to provide access to the room. A window may be positioned in the door to permit viewing of the room interior. If desired for a particular application, windows can be located in any or all of the panels. The ceiling is used to provide ventilation and light.

The above, and other features of the invention, including various novel details of construction and combination of parts, will now be more particularly described with reference to the accompanying drawings and pointed out in the claims. It will be understood that the particular modular seclusion room embodying the invention is shown by way of illustration only and not as a limitation of the invention. The principle features of this invention may be employed in various embodiments without departing from the scope of the invention.

DETAILED DESCRIPTION OF THE INVENTION

Figure 1:
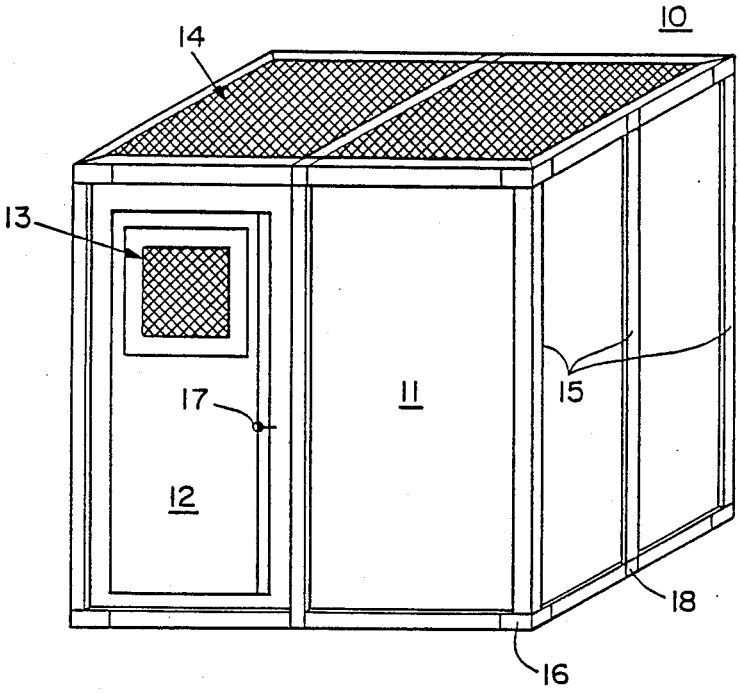
FIG. 1 illustrates a perspective view of the exterior of the modular seclusion room.

A preferred embodiment of the present invention is illustrated in FIG. 1. This perspective of the modular seclusion room 10 shows a plurality of laminated panels 11 supported by a frame 15. One of the four walls has a door 12 used for gaining access to the room. The door can be provided with a window 13 to permit continuous observation of the room interior. A latch 17 is used to secure the door 12 from the outside. The ceiling 14 is used to provide lighting and ventilation to the seclusion room interior. The present embodiment utilizes a fine metal grating such that the structure in which the seclusion room is placed provides the lighting and ventilation through the grating. Other embodiments, however, can utilize independent lighting and ventilation systems mounted on or adjacent to the room such that the ceiling 14 seals the room interior. The grating of ceiling 14 is comprised of a fine mesh to prevent tampering by the patient. The window 13 may also be comprised of a fine mesh grating, or of plexiglass, or some other transparent and tamper resistant medium.

Figure 2:
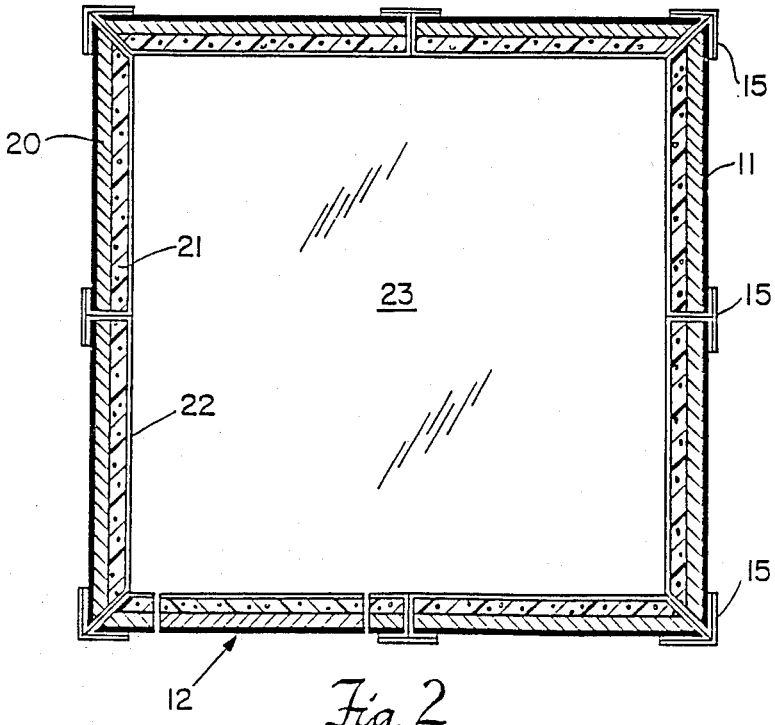
FIG. 2 illustrates a top cross-sectional view of the seclusion room wall structure and floor.

FIG. 2 illustrates a top cross-sectional view of the modular seclusion room 10. The exterior surface of each panel 20 is covered with a material 11, such as a laminate, to provide a tamper resistant surface. The panel is comprised of a fire resistant material such as aluminum or fire treated plywood, to ensure compliance with all fire codes. The panels 20 are held together by frame 15 and a door 12 is configured on one side. A foam padding 21 is placed on the inside of each wall panel (and floor 23) that is shock absorbent and fire resistant. A polymeric cloroprene can be used as the fire resistant element. The thickness of the foam can be varied to provide the desired firmness and shock absorbing qualities. A variety of applications can thereby be served simply by changing the foam thickness. The foam also forms an acoustically isolated environment within the seclusion room.

Each panel's interior surface within the seclusion room is covered with a seamless lining 22 that is attached to the frame by a single seam at each edge where adjacent surfaces meet. The lining 22 can be comprised of an outer abrasion resistant sheet, an insulating membrane and a vapor retarder flush with the interior of the panelling. The outer sheet can be made of a heavy vinyl chlorinated polyethylene, or fire retardant vinyl, or some other fire retardant and abrasion resistant material so that the interior surface exposed to the patient cannot be easily ignited. The interior surface can also be coated with a material having a therapeutically suitable color.

Figure 3:
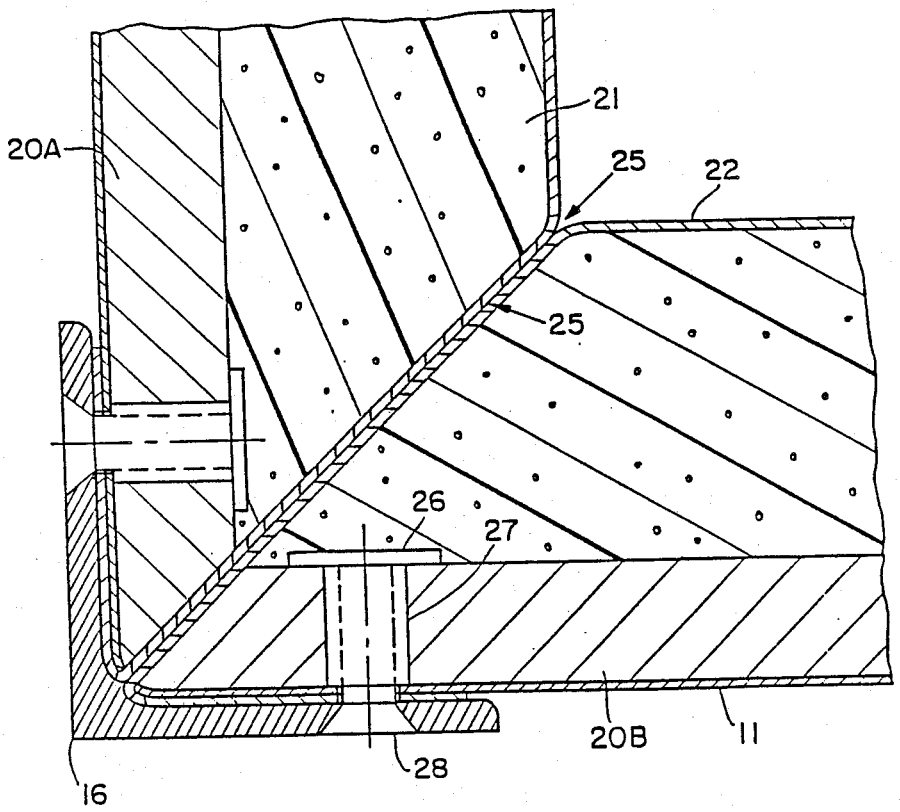
FIG. 3 illustrates a cross-sectional view of the corner bracket design of the seclusion room.
Figure 4:
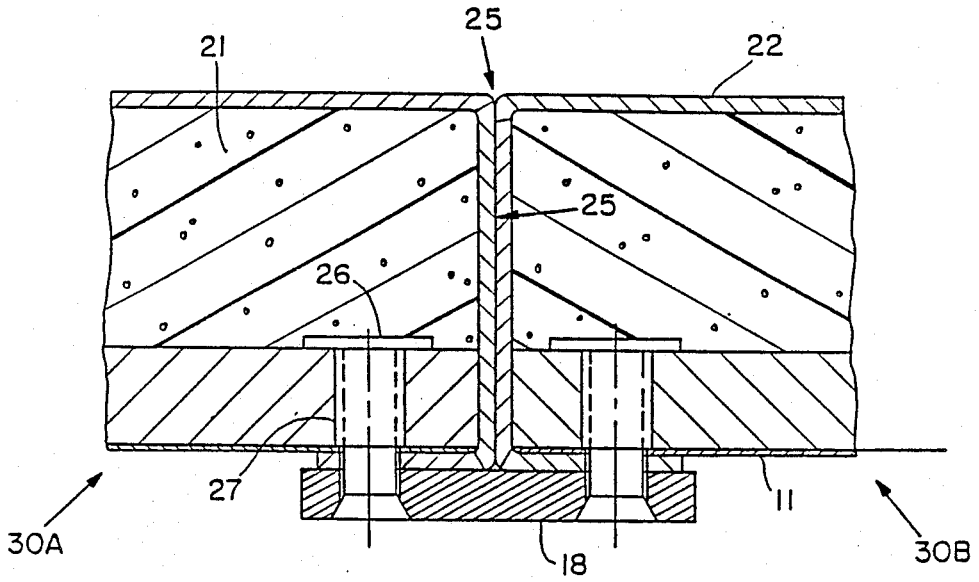
FIG. 4 illustrates a cross-sectional view of the panel bracket design of the seclusion room.

A cross-section of the corner bracket 16 and the side bracket 18 of FIG. 1 are shown in FIGS. 3 and 4 respectively,to illustrate the manner in which the structural components are secured. FIG. 3 shows two panels 20A and 20B comprised of plywood or some other suitable fire retardant material which meet at the corner plate 16. The plate 16 along with bolts 28 and nuts 26 are used to secure the entire structure.

Holes 27 through each fire retarding panel 20 permit each bolt 28 to secure the outer cover 11, the panel 20, a foam layer covering 21, and the lining 22, to the bracket 16. A single seam 25, located along each side of the interior surface of each panel provides for the interior lining 22 to fold about the edge of the foam layer and be secured between the exterior surface 11 and the adjacent bracket 16.

The bolts 28 may be coated with commercially available materials that lock the screws upon tightening. This prevents any tampering that might occur when other non-confined patients are given access to the room exterior. The application of this sealer to the bolts does not interfere with the easy dismantling of the modular unit for storage, or for transport to another location for re-assembly and use.

The seclusion room can be made to fit within any designated space that is consistent with the treatment of the behavioral problems outlined above. A preferred embodiment of the seclusion room is modular, thereby permitting it to be constructed in a number of possible configurations. For example, the panels can have dimensions 2'×8' or 4'×8'. This would permit the construction of rooms having dimensions of any combination of these panel sizes. For example, rooms might have dimensions of 8'×8'; 8'×10'; 10'×10'; 8'×12'; or 10'×12'.

The latch 17 is of such a design that an attendant is required to hold the latch in the locked position, which thereby ensures continuous observation of the violent patient.

We claim:

1. A patient seclusion room comprising:

four vertical walls having interior and exterior surfaces and supported by a frame such that the walls form an enclosed room for confining a violent patient;

a floor of the enclosed room having interior and exterior surfaces;

a ceiling of the enclosed room such that lighting and ventilation are provided to the room through said ceiling;

an externally controlled, closeable entrance through one wall of the room such that the entrance cannot be opened from within the room;

a window through said entrance such that the room can be viewed;

a resilient padding material covering substantially all of the interior surfaces of the walls and floor of said room and such that said padding material is fire retardant, and shock absorbent;

a plurality of abrasion resistant panels on the exterior surfaces of the walls; and an abrasion resistant lining formed over the interior surfaces and covering the padding material and extending through seams in the padding material, the walls, the floor and the panels, such that the lining is secured to the walls between the floor and the frame.

2. A seclusion room as recited in claim 1 wherein said panels are comprised of a fire retardant material.

3. A seclusion room as recited in claim 2 wherein said fire retardant material is comprised of a high pressure laminate.

4. A seclusion room as recited in claim 2 wherein said fire retardant material is comprised of vinyl.

5. A seclusion room as recited in claim 2 wherein said frame is comprised of a metal.

6. A seclusion room as recited in claim 2 wherein said seclusion room is modular such that the number and size of said panels is adjustable.

7. A seclusion room as recited in claim 1 wherein said fire retardant lining is comprised of chlorinated polyethylene.

8. A seclusion room as recited in claim 1 wherein said lining is comprised of vinyl.

9. A seclusion room as recited in claim 1 wherein said ceiling is comprised of a fine mesh grating.

10. A seclusion room as recited in claim 9 further comprising means for providing ventilation and lighting through said grating.

11. A seclusion room as recited in claim 1 wherein said window is comprised of a fine mesh grating.

12. A seclusion room comprising:

an enclosed room for confining a violent patient having a plurality of support surfaces;

a plurality of interior surfaces of said room, each comprised of a seamless lining;

means for providing ventilation and lighting to said room;

a plurality of outer abrasion resistant panels secured to an exterior surface of each support surface; and a padding material underneath each seamless lining and secured to each support surface such that the lining is shock absorbent, fire resistant, and extends through seams between adjacent support surfaces and is secured to the exterior surface of each support.

13. A seclusion room as recited in claim 12 further comprising an exterior surface of said room that is tamper resistant.

14. A seclusion room as recited in claim 12 wherein said lining is fire retardant and abrasion resistant.

15. A seclusion room as recited in claim 12 wherein said padding material is comprised of neoprene.

16. A seclusion room as recited in claim 12 wherein said padding material is comprised of a combustion resistant, fire retardant polyurethane foam.

* * * * *